US009725267B2

(12) United States Patent
Makida et al.

(10) Patent No.: US 9,725,267 B2
(45) Date of Patent: Aug. 8, 2017

(54) CONVEYANCE PATH FORMING BODY AND CONVEYING MACHINE

(71) Applicant: FUJI XEROX CO., LTD., Tokyo (JP)

(72) Inventors: Seigo Makida, Kanagawa (JP); Takao Furuya, Kanagawa (JP); Kiyoshi Hosoi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 19 days.

(21) Appl. No.: 14/614,527

(22) Filed: Feb. 5, 2015

(65) Prior Publication Data

US 2016/0001998 A1 Jan. 7, 2016

(30) Foreign Application Priority Data

Jul. 4, 2014 (JP) ..... 2014-138572

(51) Int. Cl.
*B65H 5/38* (2006.01)
*B65H 5/06* (2006.01)

(52) U.S. Cl.
CPC ..... *B65H 5/062* (2013.01); *B65H 5/38* (2013.01); *B65H 2404/513* (2013.01); *B65H 2404/5211* (2013.01); *B65H 2404/52132* (2013.01); *B65H 2404/611* (2013.01)

(58) Field of Classification Search
CPC ..... B65H 5/062; B65H 5/068; B65H 5/36; B65H 5/38; B41J 11/0045; B41J 11/005
See application file for complete search history.

(56) References Cited

U.S. PATENT DOCUMENTS 6,587,232 B1 * 7/2003 Yamamoto ..... B41J 2/465 358/496
7,021,618 B2 4/2006 Watanabe et al.
7,523,932 B2 * 4/2009 Morisaki ..... B65H 7/06 271/10.03
2011/0037217 A1 * 2/2011 Hung ..... H04N 1/00909 271/3.14
2012/0147441 A1 * 6/2012 Lien ..... H04N 1/00013 358/474
2013/0293937 A1 11/2013 Kato et al.
2015/0054897 A1 * 2/2015 Ito ..... B41J 11/005 347/104

FOREIGN PATENT DOCUMENTS

CN 1241266 1/2000
JP 2000-118788 4/2000
(Continued)

OTHER PUBLICATIONS

Office Action issued in corresponding Chinese patent application No. 201510104290.9, dated Dec. 5, 2016.
(Continued)

*Primary Examiner* — Luis A Gonzalez
(74) *Attorney, Agent, or Firm* — Fildes & Outland, P.C.

(57) ABSTRACT

A conveyance path forming body includes: a first surface that is disposed on an opposite side of a sheet to a processing unit disposed on a side of one surface of the sheet being conveyed along a conveyance path to perform processing on the one surface; and a second surface that is disposed at a downstream of the first surface in a conveying direction of the sheet so as to be more distant from the processing unit than a hypothetical extension surface of the first surface.

8 Claims, 8 Drawing Sheets

(56) References Cited

FOREIGN PATENT DOCUMENTS

| | | |
|---|---|---|
| JP | 2003-092662 | 3/2003 |
| JP | 2005-094060 | 4/2005 |
| JP | 2011-101983 | 5/2011 |
| JP | 2013-236158 | 11/2013 |

OTHER PUBLICATIONS

English language translation of Office Action issued in corresponding Chinese patent application No. 201510104290.9, dated Dec. 5, 2016.
Abstract and machine translation of JP 2005-094060.
Abstract and machine translation of JP 2011-101983.
Abstract and machine translation of JP 2003-092662.

* cited by examiner

CONVEYANCE PATH FORMING BODY AND CONVEYING MACHINE

CROSS-REFERENCE TO RELATED APPLICATIONS

This application is based on and claims priority under 35 USC 119 from Japanese Patent Application No. 2014-138572 filed on Jul. 4, 2014.

BACKGROUND

Technical Field

The present invention relates to a conveyance path forming body and a conveying machine.

SUMMARY

According to an aspect of the invention, there is provided a conveyance path forming body comprising: a first surface that is disposed on an opposite side of a sheet to a processing unit disposed on a side of one surface of the sheet being conveyed along a conveyance path to perform processing on the one surface; and a second surface that is disposed at a downstream of the first surface in a conveying direction of the sheet so as to be more distant from the processing unit than a hypothetical extension surface of the first surface.

DESCRIPTION OF SYMBOLS

1 . . . Conveying machine; 2 . . . Control unit; 3 . . . Processing unit; 10 . . . Conveying unit; 11 . . . Roller units; 12 . . . Conveyance path; 13 . . . Opening; 21, 22, 23, 24 . . . Contact portions; 25 . . . Step; 26 . . . Projection; 201 . . . First surface; 202 . . . Second surface; 203 . . . Third surface; 204 . . . Fourth surface; 205 . . . Fifth surface; 206 . . . Sixth surface.

Detailed Description

[1] Exemplary Embodiment

Figure 1:
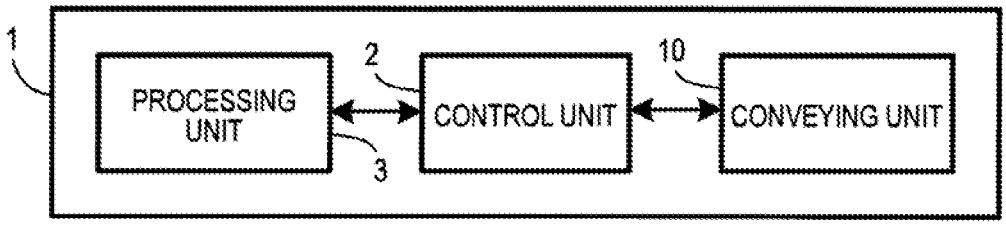
FIG. 1 shows an overall configuration of a conveying machine.

FIG. 1 shows an overall configuration of a conveying machine 1 according to an exemplary embodiment which conveys a sheet such as a sheet of paper or an OHP (overhead projector) film. The conveying machine 1 according to the exemplary embodiment conveys a sheet that is output from an image forming apparatus (not shown) and on which an image has been formed. The conveying machine 1 is equipped with a control unit 2, a processing unit 3, and a conveying unit 10.

The control unit 2 is equipped with a CPU (central processing unit), a RAM (random access memory), a ROM (read-only memory), and a storage unit. The CPU controls the individual units by running programs stored in the ROM or the storage unit using the RAM as a work area. The conveying unit 10 conveys a sheet along a conveyance path. The processing unit 3 performs processing on the sheet being conveyed by the conveying unit 10 (in the exemplary embodiment, performs processing of reading an image formed on the sheet).

Figure 2:
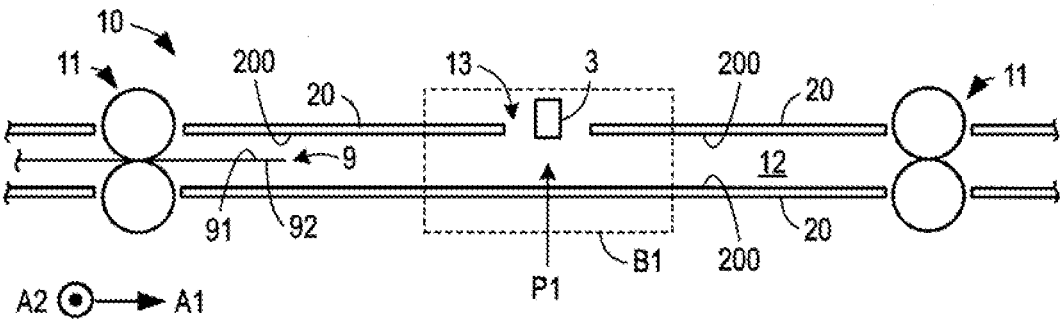
FIG. 2 shows the configuration of a conveying unit (a processing unit is also shown).

FIG. 2 shows the configuration of the conveying unit 10 (the processing unit 3 is also shown). In FIG. 2, to facilitate understanding of the description, a sheet 9 which is an example of a sheet that is conveyed in a conveying direction A1 along a conveyance path 12 by the conveying unit 10 is drawn with no warp (actually, it warps due to gravity etc.). FIG. 2 and drawings following it and showing manners of sheet conveyance are views as seen in a direction A2 that is the width direction of a sheet being conveyed and is perpendicular to the conveying direction A1. Since the direction A2 is the width direction of the conveyance path 12, it will be referred to below as a "width direction A2". The conveying unit 10 is equipped with roller units 11 and a guide unit 20. Each roller unit 11 has a pair of rollers that are supported rotatably. The roller units 11 convey a sheet in the conveying direction A1. The conveying direction A1 is approximately parallel with the horizontal direction around the processing unit 3. In FIG. 2, the sheet 9 is an example of a sheet that is conveyed by the roller units 11.

The guide unit 20 has surfaces 200 that face the conveyance path 12. The surfaces 200 are disposed on the side of one surface 91 of the sheet 9 and on the side of the opposite surface 92 of the sheet 9; that is, the surfaces 200 are disposed so that the sheet 9 is interposed between them. The conveyance path 12 is formed by the surfaces 200. As such, the guide unit 20 is a body that forms the conveyance path 12 and is an example of a "conveyance path forming body" of the invention. The dimension of the surfaces 200 in the width direction A2 is larger than that of a sheet to be conveyed in the width direction A2 so that the sheet does not stick out of the conveyance path 12. Conveyed (pushed) in the conveying direction A1 by the roller units 11, a sheet goes forward along the conveyance path 12 while coming into contact with the surfaces 200. In this manner, the guide unit 20 guides, along the conveyance path 12, a sheet being conveyed by the roller units 11. In the following, the surfaces 200 will also be referred to as "guide surfaces 200."

FIG. 2 shows a position P1 (hereinafter referred to as a "processing position P1") where processing is performed on a sheet by the processing unit 3. In this exemplary embodiment, when the sheet 9 passes the processing position P1, one surface 91 is directed upward and the opposite surface 92 is directed downward in the vertical direction. The guide surfaces 200 on the side of the one surface (top surface) 91 have a gap, that is, an opening 13, through which the conveyance path 12 communicates with the outside. The processing unit 3 is disposed in the opening 13, that is, disposed on the side of the one surface 91 of the sheet 9. Upon arrival of the sheet 9 at the processing position P1, the processing unit 3 performs reading processing on the one surface 91 of the sheet 9. Part B1 (where the processing unit 3 is disposed; see FIG. 2) of the conveying unit 10 will be described below with reference to FIG. 3.

Figure 3:
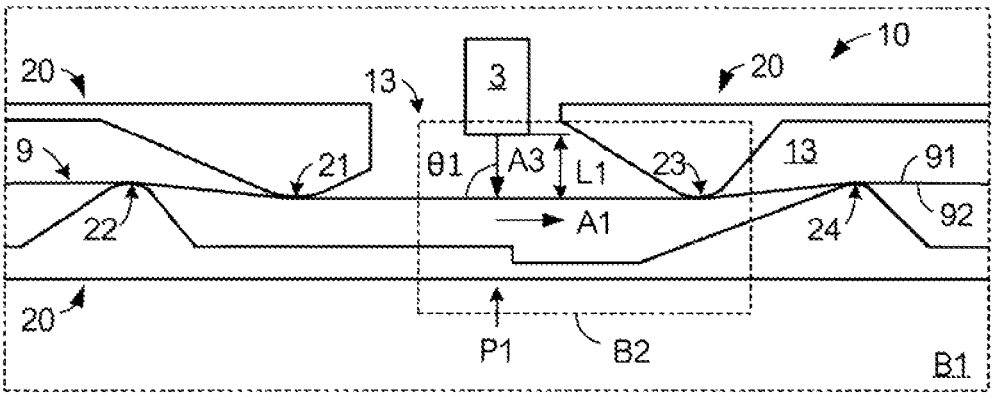
FIG. 3 shows part B1 of FIG. 2 in an enlarged manner.

FIG. 3 shows part B1 of FIG. 2 in an enlarged manner. The guide unit 20 has first to fourth contact portions 21-24. The first contact portion 21 and the second contact portion 22 are located at an upstream of the processing position P1. The first contact portion 21 is to touch the one surface 91 of the sheet 9 at an upstream of the processing position P1, and the second contact portion 22 is to touch the opposite surface 92 of the sheet 9 at an upstream of the first contact portion 21. The first contact portion 21 is located closer to the destination side in a direction A3 which is a direction going from the processing unit 3 to the sheet 9 at the processing position P1 than the second contact portion 22. In the exemplary embodiment, since the direction A3 is the vertically downward direction, to facilitate understanding of the description, it will be referred to below as a "downward direction A3." However, the direction A3 is still defined as the direction going from the processing unit 3 to the sheet 9 at the processing position P1 and is not restricted to the vertically downward direction.

The third contact portion 23 and the fourth contact portion 24 are located at downstream of the processing position P1. The third contact portion 23 is to touch the one surface 91 of the sheet 9 at a downstream of the processing position P1, and the fourth contact portion 24 is to touch the opposite surface 92 of the sheet 9 at a downstream of the third contact portion 23. The third contact portion 23 is located closer to the destination side in the downward direction A3 than the fourth contact portion 24. FIG. 3 shows a state that the head of a sheet 9 has been conveyed to a downstream of the fourth contact portion 24 and is in contact with the first to fourth contact portions 21-24. More specifically, the one surface 91 of the sheet 9 is in contact with the first contact portion 21 and the third contact portion 23 and its opposite surface 92 is in contact with the second contact portion 22 and the fourth contact portion 24.

With the contact portions 21-24 arranged in the above-described manner, the opposite surface 92 of the sheet 9 is pushed up in the vertical direction by the second contact portion 22 and the fourth contact portion 24 and the one surface 91 of the sheet 9 is pushed down in the vertical direction by the first contact portion 21 and the third contact portion 23. Therefore, the one surface 91 of the sheet 9 is kept in contact with the first contact portion 21 and the third contact portion 23. As a result, the distance (represented by L1 in FIG. 3; hereinafter referred to as a "sheet distance") between the processing unit 3 and the one surface 91 at the processing position P1 and the angle θ1 (about 90° in FIG. 3; hereinafter referred to as a "sheet angle") formed by the one surface 91 and the downward direction A3 at the upstream side of the processing position P1 are less prone to vary than in a case that the contact portions 21-24 are not provided.

The processing unit 3 is disposed so that its image reading accuracy is high in the case where the sheet 9 passes the processing position P1 with the sheet distance L1 and the sheet angle θ1 shown in FIG. 3. Therefore, in the conveying machine 1, the processing accuracy (in the exemplary embodiment, image reading accuracy) of the processing unit 3 is higher in a state that the sheet 9 is in contact with the contact portions 21-24 than in a case that the contact portions 21-24 are not provided. In the following description, the sheet distance L1 and the sheet angle θ1 shown in FIG. 3 will be referred to as a "reference sheet distance L1" and a "reference sheet angle θ1," respectively. The processing accuracy of the processing unit 3 increases as the sheet length becomes closer to the reference sheet distance L1 or the sheet angle becomes closer to the reference sheet angle θ1.

Figure 4:
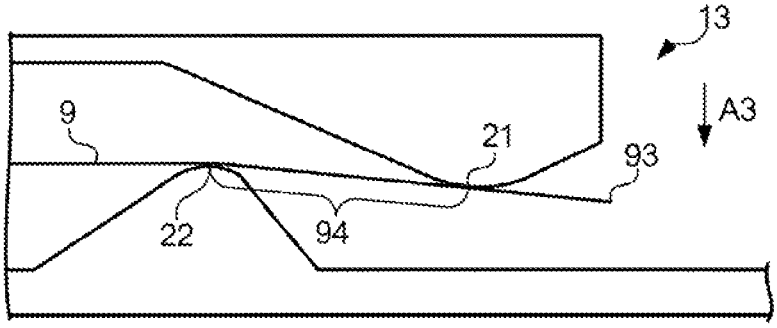
FIG. 4 shows a first contact portion and a second contact portion in an enlarged manner.

FIG. 4 shows the first contact portion 21 and the second contact portion 22 in an enlarged manner. FIG. 4 shows a state that a portion, adjacent to the head 93, of the sheet 9 is in contact with the first contact portion 21 and the second contact portion 22. As mentioned above, the first contact portion 21 is located closer to the destination side in the downward direction A3 than the second contact portion 22. With this arrangement, the sheet 9 is conveyed in such a manner that a portion, a downstream of a portion 94 between the first contact portion 21 and the second contact portion 22, of the sheet 9 is inclined so as to go down, that is, go away from the processing unit 3 and the opening 13, as the position goes downstream. As a result, the probability that the sheet 9 goes out through the opening 13 or collides with the processing unit 3 is lower than in a case that neither first contact portion 21 nor the second contact portion 22 is provided.

Figure 5:
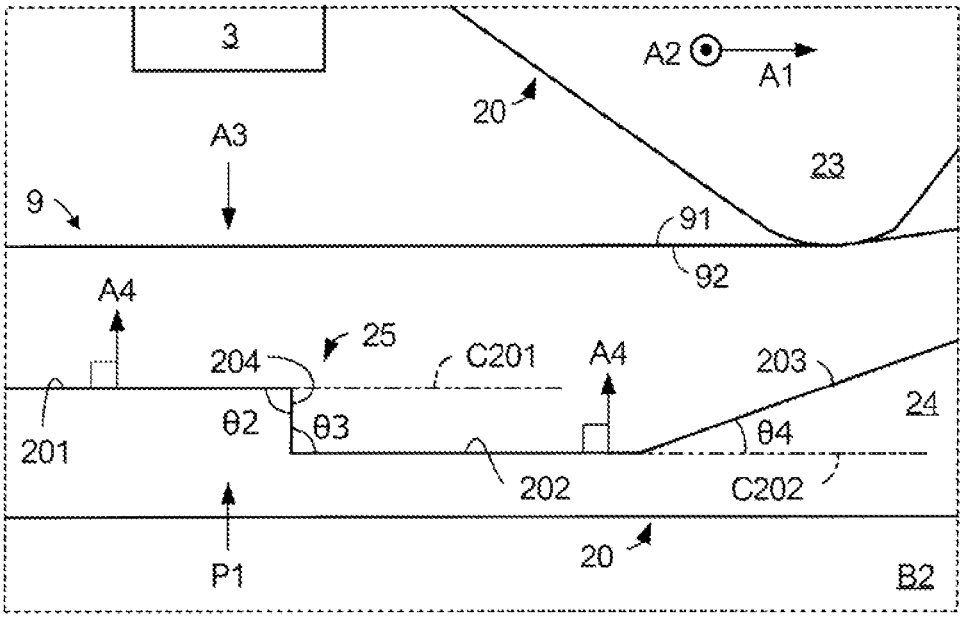
FIG. 5 shows part B2 of FIG. 3 in an enlarged manner.

FIG. 5 shows part B2 of FIG. 3 in an enlarged manner. The guide unit 20 has first to fourth surfaces 201-204 on the side of the opposite surface 92 of the sheet 9. The first to fourth surfaces 201-204 are included in the guide surfaces 200 shown in FIG. 2. The dimension of the first to fourth surfaces 201-204 in the width direction A2 is larger than that of a sheet to be conveyed in the width direction A2. The first surface 201, the fourth surface 204, the second surface 202, and the third surface 203 are arranged continuously in this order from the upstream side in the conveying direction A1.

The first surface 201 is located on the opposite side of the sheet 9 to the processing unit 3. The first surface 201 faces the destination side in a direction A4 which is opposite to the above-mentioned downward direction A3 (i.e., the direction going from the processing unit 3 to the sheet 9 at the processing position P1). In the exemplary embodiment, since the direction A4 is the vertically upward direction, to facilitate understanding of the description, it will be referred to below as an "upward direction A4." However, the direction A4 is still defined as the direction opposite to the direction A3 and is not restricted to the vertically upward direction.

The first surface 201 extends from an upstream of the processing position P1 to a downstream of it. The fourth surface 204 which is continuous with the downstream end of the first surface 201 faces the destination side in the conveying direction A1. The second surface 202 which is continuous with the bottom end of the fourth surface 204 faces the destination side in the upward direction A4. The angle θ2 formed by the first surface 201 and the fourth surface 204 and the angle θ3 formed by the second surface 202 and the fourth surface 204 are about 90°. The first surface 201 and the fourth surface 204 form a projected edge and the second surface 202 and the fourth surface 204 form a recessed edge. That is, the first surface 201, the fourth surface 204, and the second surface 202 form a step 25.

The second surface 202 is provided at a downstream of the first surface 201 so as to be more distant from the processing unit 3 than a hypothetical extension surface C201 of the first surface 201. In other words, the second surface 202 is located on the opposite side (on the destination side in the downward direction A3) of the hypothetical extension surface C201 to the processing unit 3 (which is located on the destination side in the upward direction A4). The second surface 202 is located at a downstream of the processing position P1. The fact that the first surface 201 and the second surface 202 are disposed in the above-described manner influences the conveying speed of a sheet at the processing position P1. The conveying speed of a sheet at the processing position P1 means a speed of a portion, passing the processing position P2, of a sheet in the conveying direction A1. This influence will be described below with reference to FIGS. 6A and 6B and FIGS. 7A and 7B.

Figure 6A:
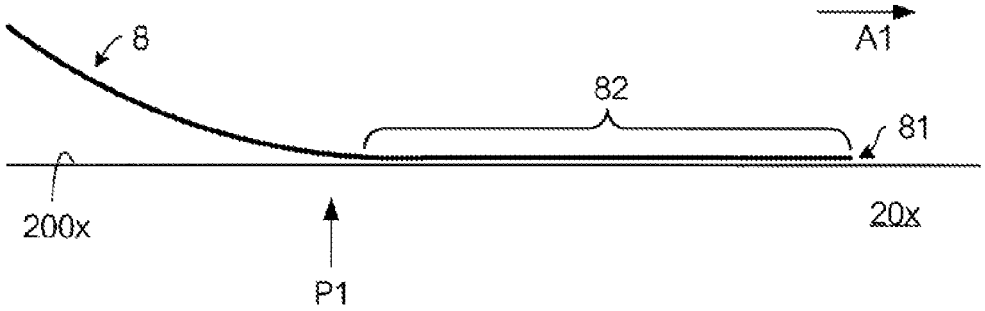
FIGS. 6A and 6B illustrate example modes of conveyance in which a head portion of a sheet is passing a processing position.
Figure 6B:
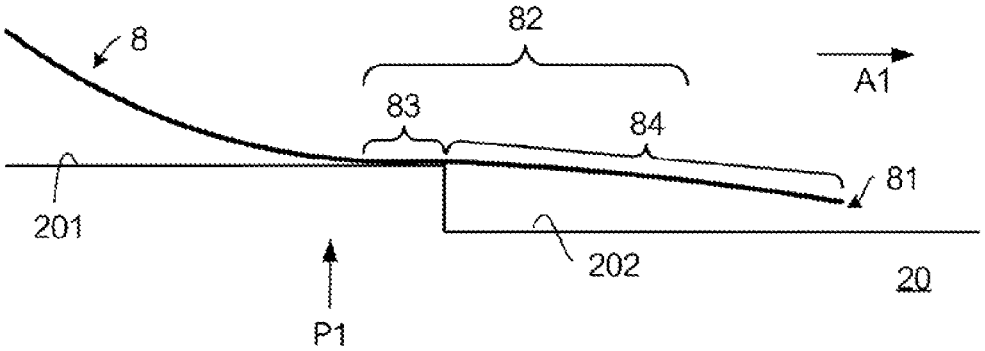

FIGS. 6A and 6B illustrate example modes of conveyance in which a head portion of a sheet 8 which is relatively thin and low in stiffness among various kinds of sheets is passing the processing position P1. The example of FIG. 6A is of a case that a guide unit 20*x* has neither the first surface 201 nor the second surface 202. More specifically, the guide unit 20*x* has a guide surface 200*x* which is located on the opposite side of the sheet 8 to the processing unit 3. The guide surface 200*x* faces the destination side in the upward direction A4 and exists in the same plane as the first surface 201 and its hypothetical extension surface C201 (see FIG. 5). A head portion 82 (the head is denoted by reference numeral 81) of the sheet 8 which is low in stiffness is warped downward due to gravity, and is in close contact with the guide surface 200*x* because it cannot bear its own weight. Force acts on the sheet 8 in the direction opposite to the conveying direction A1 because frictional force and electrostatic force are generated due to the close contact between the head portion 82 and the guide surface 200*x*.

Figure 7A:
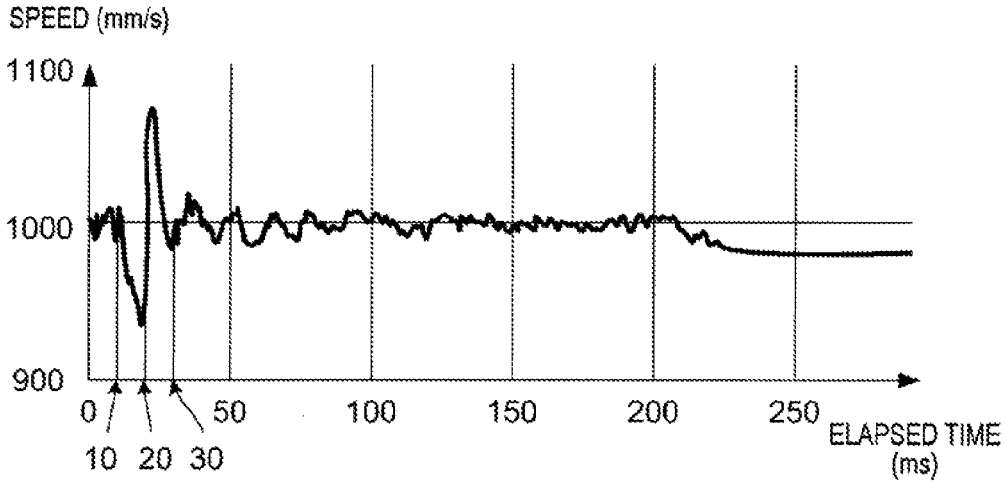
FIGS. 7A and 7B are graphs showing example measurement results of sheet conveying speeds at the processing position.
Figure 7B:
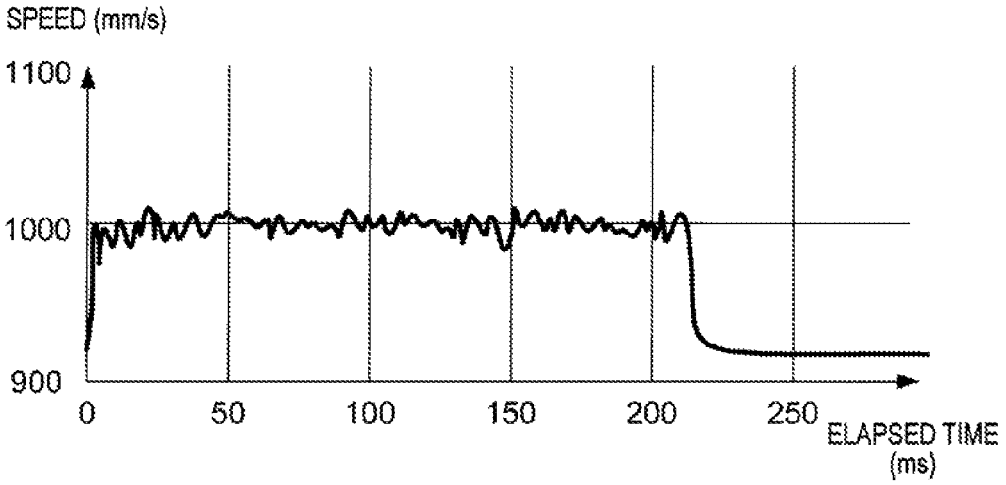

FIGS. 7A and 7B are graphs showing example measurement results of sheet conveying speeds at the processing position P1. In FIGS. 7A and 7B, the vertical axis represents the sheet conveying speed (in mm/s) and the horizontal axis represents the elapsed time (in ms). FIG. 7A shows a variation of the sheet conveying speed in the example of FIG. 6A. In this example, the sheet conveying speed falls approximately in a period of 10 to 20 ms. This is considered due to the force that acts on the sheet 8 in the direction opposite to the conveying direction A1 (described above with reference to FIG. 6A). This force vanishes at about 20 ms and, as a reaction, the sheet conveying speed increases thereafter. A sheet conveying speed of about 1,000 mm/s is maintained approximately after 30 ms, that is, after settlement of the reaction.

The example of FIG. 6B is of a case that the sheet 8 is conveyed by the conveying unit 10 according to the exemplary embodiment. In this example, although a head portion 82 (the head is denoted by reference numeral 81) of the sheet 8 is warped downward due to gravity, only an upstream portion 83 of the head portion 82 is in close contact with the first surface 201 because the first surface 201 is terminated halfway. Although a downstream portion 84 of the head portion 82 is also warped downward, in this example it is not in contact with the second surface 202 yet. Therefore, in the example of FIG. 6B, the area of close contact between the sheet 8 and the guide surfaces 200 including the first surface 201 and the second surface 202 is smaller than in the example of FIG. 6A. As a result, the force that acts on the sheet 8 in the direction opposite to the conveying direction A1 is weaker accordingly.

FIG. 7B shows a variation of the sheet conveying speed in the example of FIG. 6B. In this example, the sheet conveying speed at the processing position P1 does not fall much even in the period of 10 to 20 ms when the sheet 8 would come into contact with the first surface 201. Instead, a sheet conveying speed of about 1,000 mm/s is maintained constantly. Thus, in the exemplary embodiment, the sheet conveying speed at the processing position P1 is more stable than in the case of a guide portion having neither the first surface 201 nor the second surface 202.

Furthermore, in the exemplary embodiment, the first surface 201 extends to a downstream of the processing position P1. If the first surface 201 were terminated at a position upstream of the processing position P1 and the area of the second surface 202 included the processing position P1, the area of a downstream portion 84 of a head portion 82 (see FIG. 6B) would include the processing position P1. Since the downstream portion 84 is not in contact with any of the guide surfaces 200, it is more prone to flutter than in a case that it is in contact with one of the guide surfaces 200. In the exemplary embodiment, since as described above the first surface 201 extends to a downstream of the processing position P1, the degree of sheet fluttering is made lower than in a case that the first surface 201 does not extend so.

Returning to FIG. 5, the third surface 203 is continuous with the downstream end of the second surface 202. The third surface 203 is inclined from a hypothetical extension surface C202 of the second surface 202 toward the side of the processing unit 3 so as to form an angle θ4 with the hypothetical extension surface C202. As the angle θ4 increases, the angle at which a sheet collides with the third surface 203 becomes closer to 90° and more prone to bend. In view of this, the angle θ4 is set at such a value (e.g., 45° or less) that a sheet does not bend when colliding with the third surface 203.

Figure 8A:
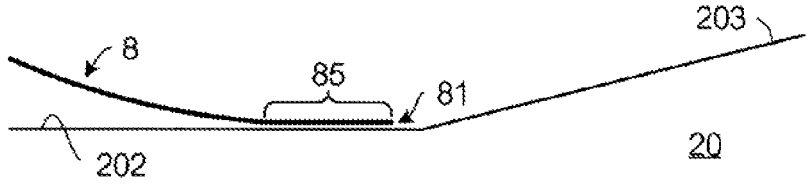
FIGS. 8A and 8B illustrate a mechanism for separating a sheet from a second surface.
Figure 8B:
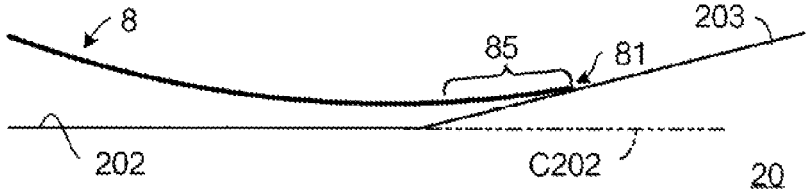

The third surface 203 plays a role of separating a head portion of a sheet from the second surface 202 when the head portion comes into close contact with the second surface 202. FIGS. 8A and 8B illustrate a mechanism for separating a sheet from the second surface 202. FIG. 8A shows a state that a head portion 85 (the head is denoted by reference numeral 81) of a sheet 8 (of a type described above with reference to FIGS. 6A and 6B) is in close contact with the second surface 202. After reaching the third surface 203, the head 81 is moved along the third surface 203 so as to go away from the hypothetical extension surface C202 (see FIG. 5). It is assumed that the sheet 8 is relatively thin and low in stiffness among various kinds of sheets but is still so stiff that the head portion 85 does not warp to come into contact with the third surface 203. In the exemplary embodiment, in the case where a sheet that is as stiff as the sheet 8 is conveyed, it is made less prone to come into contact with the second surface 202 than in the case of a guide unit not having the third surface 203.

[2] Modifications

The above-described exemplary embodiment is just one example mode for carrying out the invention and can be modified in the following manners. The above-described exemplary embodiment and each of the following modifications may be combined with each other when necessary.

[2-11] First Surface and Second Surface

Guide units are possible whose first surface and second surface are different than in the exemplary embodiment.

Figure 9A:
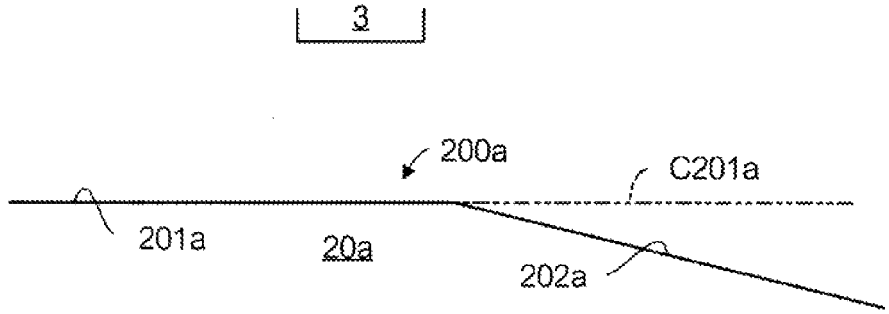
FIGS. 9A and 9B show a guide unit according to a modification.
Figure 9B:
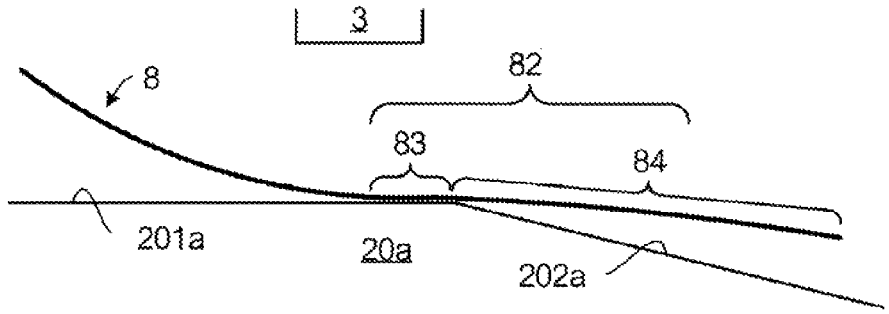

FIGS. 9A and 9B show a guide unit 20*a* according to a modification which has guide surfaces 200*a* which include a first surface 201*a* and a second surface 202*a*. As shown in FIG. 9A, the second surface 202*a* is continuous with the downstream end of the first surface 201*a* and is inclined from a hypothetical extension surface C201*a* of the first surface 201*a* so as to go away from the side of the processing unit 3. This modification is the same as the exemplary embodiment in that the second surface 202*a* is more distant from the processing unit 3 than the hypothetical extension surface C201*a*.

As shown in FIG. 9B, when a sheet 8 comes into contact with the first surface 201*a*, a situation occurs that only an upstream portion 83 of a head portion 82 is in close contact with the first surface 201*a* and a downstream portion 84 of the head portion 82 is not in contact with any of the guide surfaces 200*a*.

As a result, even with the first surface 201*a* and the second surface 202*a* which are continuous with each other, as in the exemplary embodiment, the sheet conveying speed at the processing position P1 is made more stable than in the case of a guide unit having neither the first surface 201*a* nor the second surface 202*a*.

Figure 10A:
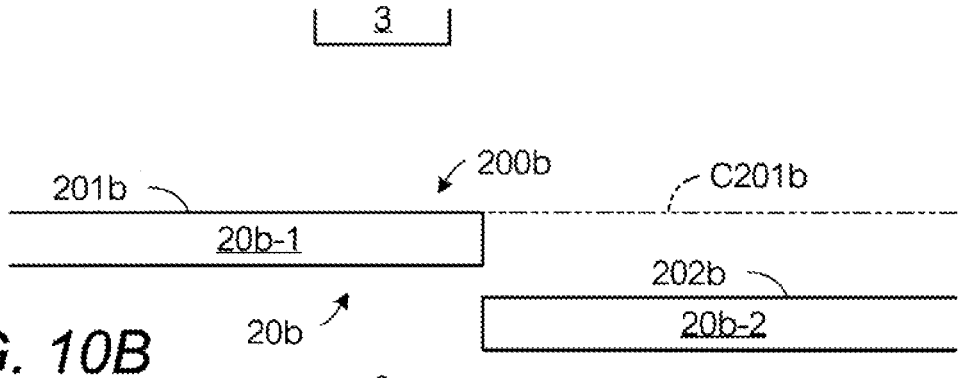
FIGS. 10A and 10B show a guide unit according to another modification.
Figure 10B:
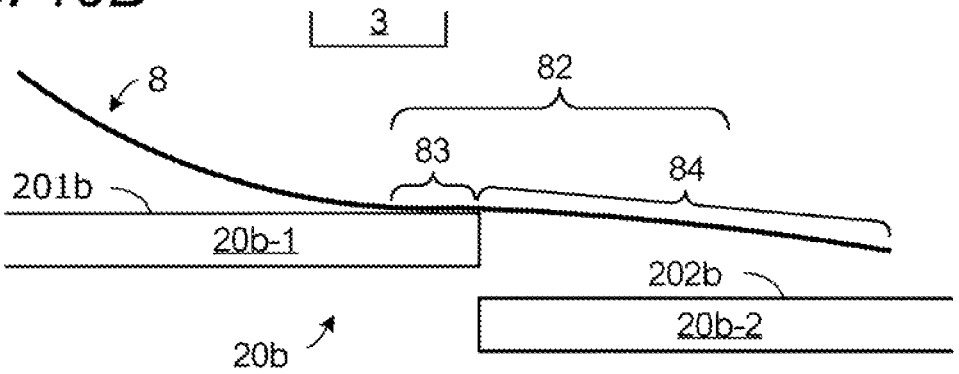

FIGS. 10A and 10B show a guide unit 200*b* according to another modification which has guide surfaces 200*b* which include a first surface 201*b* and a second surface 202*b*. As shown in FIG. 10A, the guide unit 200*b* is provided with an upstream member 20*b*-1 having a first surface 201*b* and a downstream member 20*b*-2 having a second surface 202*b*. In this modification, the second surface 202*b* is disposed at a downstream of the first surface 201*b* so as to be more distant from the processing unit 3*b* than a hypothetical extension surface C201*b* of the first surface 201*b*.

As shown in FIG. 10B, when a sheet 8 comes into contact with the first surface 201*b*, a situation occurs that only an upstream portion 83 of a head portion 82 is in close contact with the first surface 201*b* and a downstream portion 84 of the head portion 82 is not in contact with any of the guide surfaces 200*b*.

As a result, even with the first surface 201*b* and the second surface 202*b* which are surfaces of different members, the sheet conveying speed at the processing position P1 is made more stable than in the case of a guide unit having neither the first surface 201*b* nor the second surface 202*b*.

Figure 11A:
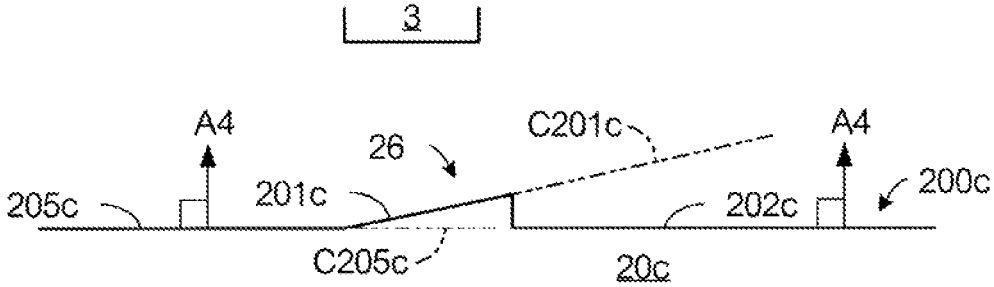
FIGS. 11A and 11B show a guide unit according to still another modification.
Figure 11B:
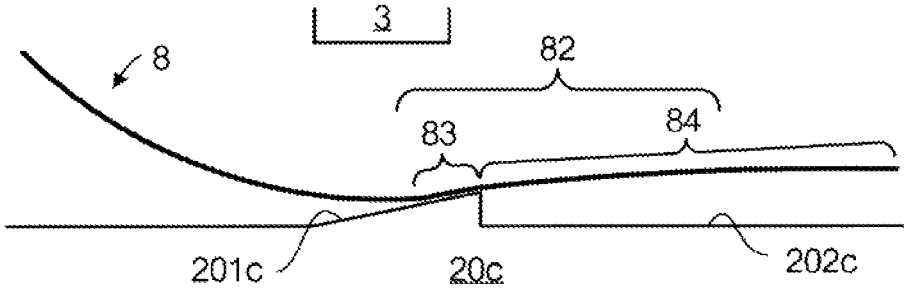

FIGS. 11A and 11B show a guide unit 20*c* according to still another modification which has guide surfaces 200*c* which include a first surface 201*c*, a second surface 202*c*, and a fifth surface 205*c*. As shown in FIG. 11A, the fifth surface 205*c* is continuous with the upstream end of the first surface 201*c* and faces the destination side in the above-mentioned upward direction A4. The first surface 201*c* is inclined from a hypothetical extension surface C205*c* of the fifth surface 205*c* toward the processing unit 3. The second surface 202*c* is disposed at a downstream of the first surface 201*c* so as to be more distant from the processing unit 3 than a hypothetical extension surface C201*c* of the first surface 201*c*. And the second surface 202*c* exists in the same plane as the hypothetical extension surface C205*c* of the fifth surface 205*c*. That is, the first surface 201*c* forms a projection 26 which projects from the fifth surface 205*c* and the second surface 202*c*.

As shown in FIG. 11B, when a sheet 8 comes into contact with the first surface 201*c*, a situation occurs that an upstream portion 83 of a head portion 82 is in close contact with the first surface 201*c* and a downstream portion 84 of the head portion 82 is not in contact with the guide unit 20*c*. As a result, as in the exemplary embodiment, the sheet conveying speed at the processing position P1 is made more stable than in the case of a guide unit having neither the first surface 201*c* nor the second surface 202*c*.

[2-2] First Surface

Although in the exemplary embodiment the first surface 201 extends from an upstream of the processing position P1 to a downstream of it, the first surface may be terminated at an upstream of the processing position P1. Even in this case, the area of close contact between a sheet and the guide surfaces is reduced, whereby the sheet conveying speed at the processing position P1 is made more stable than in the case of a guide unit having neither the first surface nor the second surface.

[2-3] Conveyance Path

Although in the exemplary embodiment the conveyance path 12 extends generally in the horizontal direction around the processing unit 3, the invention is not limited to such a case. For example, a conveyance path is possible that extends in the vertical direction around the processing unit 3 or in a direction that crosses the horizontal direction and the vertical direction. Even a conveyance path is possible that is curved around the processing unit 3.

Figure 12A:
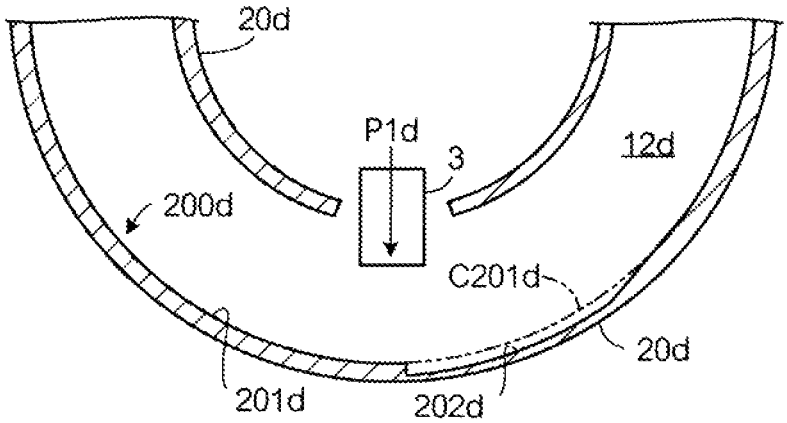
FIGS. 12A, 12B and 12C show a conveyance path according to yet another modification.
Figure 12B:
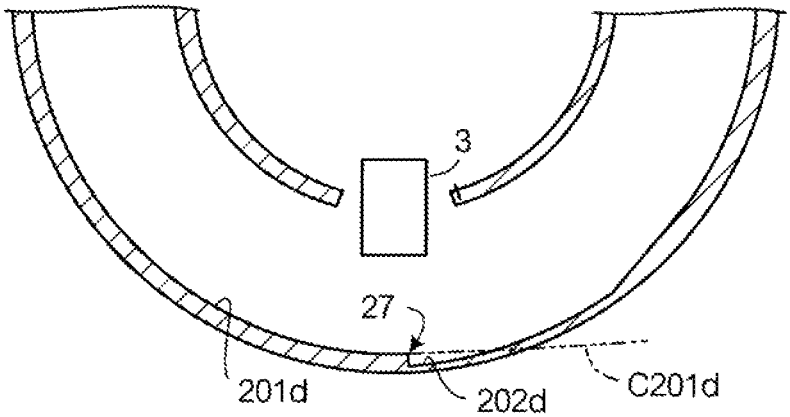
Figure 12C:
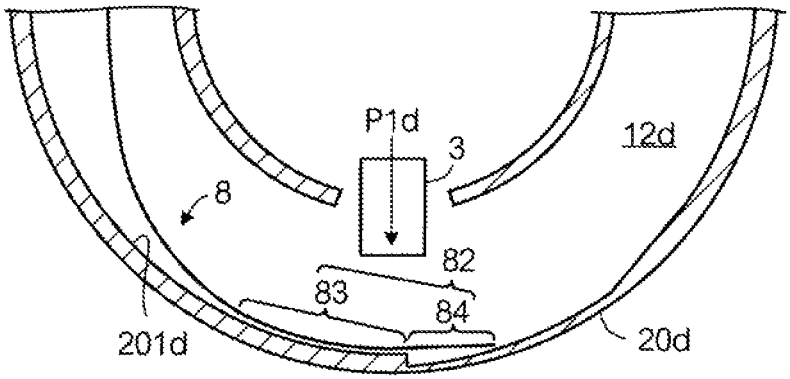

FIGS. 12A-12C show a guide unit 20*d* according to yet another modification which forms an arc-shaped conveyance path 12*d*. The processing unit 3 is disposed on the inner circumference (which assumes a smaller arc) of the conveyance path 12*d*. The guide unit 20*d* has guide surfaces 200*d* which include a first surface 201*d* which is disposed on the side opposite to the processing unit 3 and a second surface 202*d* which is disposed at a downstream of the first surface 201*d* so as to be more distant from the processing unit 3 than a hypothetical extension surface C201*d* of the first surface 201*d*. In FIG. 12A, the hypothetical extension surface C201*d* is an arc-shaped surface having the same radius as the first surface 201*d*.

As shown in FIG. 12B, another hypothetical extension surface C201*d* may be defined as a tangential surface to the first surface 201*d* at its downstream end 27. Also in this case, the guide unit 20*d* has a second surface 202*d* which is disposed at a downstream of the first surface 201*d* so as to be more distant from the processing unit 3 than the hypothetical extension surface C201*d* of the first surface 201*d*.

As shown in FIG. 12C, when a sheet 8 comes into contact with the first surface 201*d*, a situation occurs that an upstream portion 83 of a head portion 82 is in close contact with the first surface 201*d* and a downstream portion 84 of the head portion 82 is not in contact with any of the guide surfaces 200*d*. As a result, as in the exemplary embodiment, the sheet conveying speed at a processing position P1*d* is made more stable than in the case of a guide unit having neither the first surface 201*d* nor the second surface 202*d*.

[2-4] Second Surface

Although in the exemplary embodiment the dimension of the second surface 202 in the width direction A2 is larger than that of a sheet to be conveyed in the width direction A2, the invention is not limited to such a case.

Figure 13A:
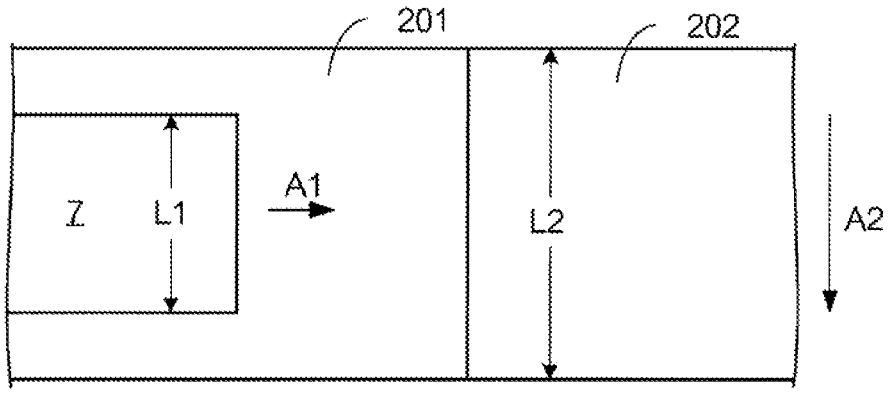
FIGS. 13A, 13B and 13C are for description of second surfaces employed in further modifications.
Figure 13B:
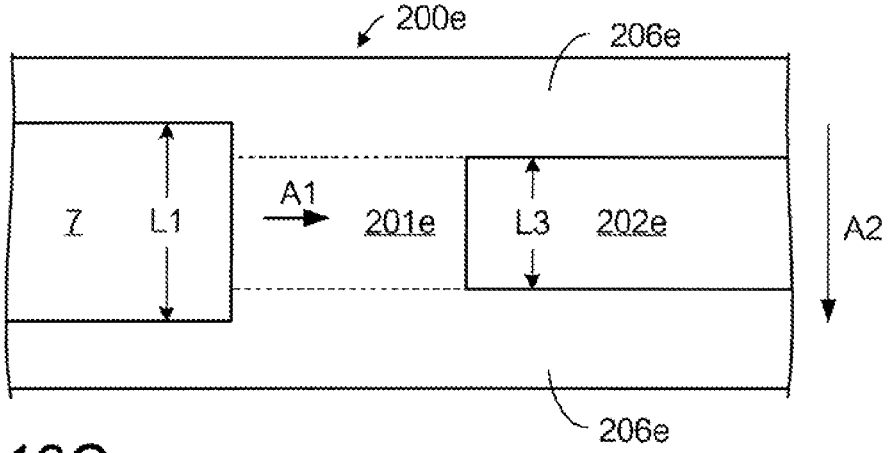
Figure 13C:
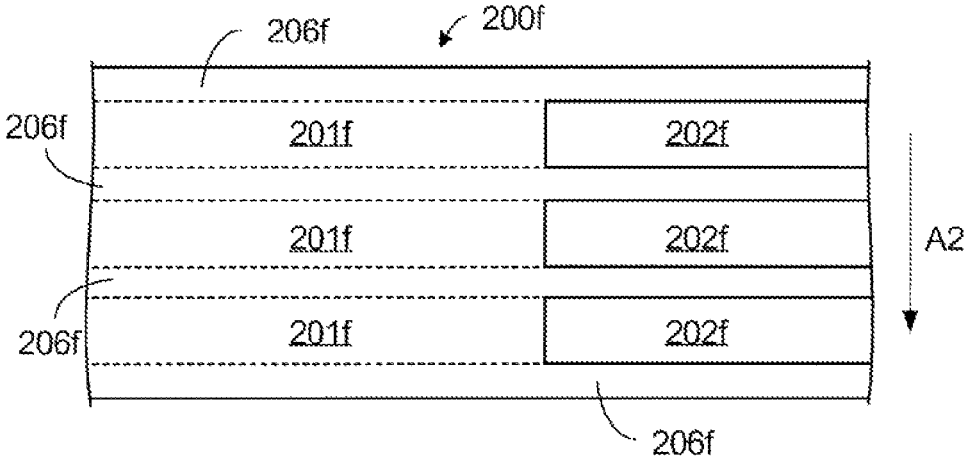

FIGS. 13A-13C are for description of second surfaces which are employed in further modifications. FIG. 13A shows the first surface 201 and the second surface 202 employed in the exemplary embodiment as viewed from the side of the processing unit 3 shown in FIG. 2 etc. FIG. 13A shows a sheet 7 whose dimension in the width direction A2 is largest (L1) among various kinds of sheets to be conveyed by the conveying machine 1. The dimension of the second surface 202 in the width direction A2 is L2 that is larger than L1.

FIG. 13B shows guide surfaces 200*e* according to a modification which include a second surface 202*e*. The second surface 202*e* whose dimension in the width direction A2 is L3 that is smaller than L1 is disposed so as to be fully covered with the sheet 7 being conveyed when viewed from the side of the processing unit 3. A first surface 201*e* is disposed at an upstream of the second surface 202*e*. Sixth surfaces 206*e* are disposed on both sides of the first surface 201*e* and the second surface 202*e* in the width direction A2.

For example, the sixth surfaces 206*e* are in the same plane as a hypothetical extension surface of the first surface 201*e*. Alternatively, like the second surface 202*e*, the sixth surfaces 206*e* may be disposed so as to be more distant from the processing unit 3 than the hypothetical extension surface of the first surface 201*e*.

Also in the modification of FIG. 13B, when the head of a sheet 7 has passed the first surface 201*e*, a situation occurs that a central portion, in the width direction A2, of a head portion of the sheet 7 is not in contact with any of the guide surfaces 200*e*. As a result, the sheet conveying speed at the processing position is made more stable than in the case of a guide unit having neither the first surface 201*e* nor the second surface 202*e*.

FIG. 13C shows guide surfaces 200*e* including three second surfaces 202*f* which are arranged in the width direction A2. First surfaces 201*f* are disposed at an upstream of the respective second surfaces 202*f*. Sixth surfaces 206*f* are disposed around the first surface 201*f* and the second surfaces 202*f*.

Also in the modification of FIG. 13C, when the head of a sheet has passed the first surfaces 201*f*, a situation occurs that portions, opposed to the second surfaces 202*f*, of the sheet are not in contact with any of the guide surfaces 200*f*. As a result, the sheet conveying speed at the processing position is made more stable than in the case of a guide unit having neither the first surfaces 201*f* nor the second surfaces 202*f*.

[2-5] Processing Performed by Processing Unit

Although in the exemplary embodiment the processing unit 3 performs image reading processing, the invention is not limited to such a case; for example, a processing unit may be employed which jets ink onto a sheet. In short, any processing unit may be employed that performs certain processing on a major surface of a medium. In particular, in the case where the sheet conveying speed at the processing position influences a result of processing, the invention makes it possible to stabilize the sheet conveying speed and thereby increase the accuracy of the processing.

[2-6] Category of the Invention

The invention is recognized as a conveyance path forming body (examples of which are the above-described guide units) which forms a conveyance path and also as a conveying machine that is obtained by adding roller units and a processing unit to the conveyance path forming body. Furthermore, where the processing unit performs image reading, the invention can be recognized as a test instrument or an image reading apparatus which outputs a reading result. Where the processing unit performs processing of jetting out ink, the invention can be recognized as an image forming apparatus. As such, the invention can be applied to any apparatus which performs processing on a sheet being conveyed and in which it is desired that the sheet conveying speed at the processing position be stable.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A conveyance path forming body comprising:

a first surface that is, disposed on an opposite side of a sheet to a processing unit disposed on a side of one surface of the sheet being conveyed along a conveyance path to perform processing on the one surface;

a second surface that is disposed at a downstream of the first surface in a conveying direction of the sheet so as to be more distant from the processing unit than a hypothetical extension surface of the first surface;

a third surface that is disposed at a downstream of the second surface in the conveying direction of the sheet so as to be continuous with the second surface and to be inclined from a hypothetical extension surface of the second surface toward a side of the processing unit;

a first contact portion to come into contact with the one surface of the sheet at an upstream of a processing position of the processing unit in the conveying direction of the sheet; and a second contact portion to come into contact with a surface, opposite to the one surface, of the sheet at an upstream of the first contact portion;

the first, second and third surfaces facing the sheet conveyed along the conveyance path and being guide surfaces that come into contact with the sheet;

the first surface extending to a downstream end of the processing unit;

in a direction going from the processing unit to the sheet, a position at which the first contact portion is to come into contact with the sheet being more distant from the processing unit than a position at which the second contact portion is to come into contact with the sheet.

2. The conveyance path forming body according to claim 1, further comprising:

a third contact portion to come into contact with the one surface of the sheet at a downstream of a processing position of the processing unit in the conveying direction of the sheet; and a fourth contact portion to come into contact with a surface, opposite to the one surface, of the sheet at a downstream of the third contact portion.

3. The conveyance path forming body according to claim 2, wherein in a direction going from the processing unit to the sheet, a position at which the third contact portion is to come into contact with the sheet is more distant from the processing unit than a position at which the fourth contact portion is to come into contact with the sheet.

4. The conveyance path forming body according to claim 1, further comprising:

a third contact portion to come into contact with the one surface of the sheet at a downstream of the processing position in the conveying direction of the sheet; and a fourth contact portion to come into contact with the surface, opposite to the one surface, of the sheet at a downstream of the third contact portion, wherein the first contact portion and the third contact portion are disposed so that a hypothetical plane including a position of contact between the first contact portion and the sheet and a position of contact between the third contact portion and the sheet is substantially perpendicular to a direction going from the processing unit to the sheet.

5. The conveyance path forming body according to claim 1, wherein a width dimension of the second surface is smaller than a width dimension of the first surface.

6. A conveying machine comprising:

the conveyance path forming body according to claim 1; and a plurality of roller units that convey the sheet in the conveying direction and each of which has a pair of rollers.

7. The conveying machine according to claim 6, further comprising the processing unit that is disposed on an opposite side of the sheet to the first surface and performs processing on the one surface of the sheet.

8. The conveyance path forming body according to claim 1, wherein the second surface is not continuous with the first surface, and a step is formed between the first and second surfaces.

* * * * *